US007197845B2

(12) United States Patent
Wilcox et al.

(10) Patent No.: US 7,197,845 B2
(45) Date of Patent: Apr. 3, 2007

(54) T-TOP OUTRIGGER HOLDER APPARATUS

(75) Inventors: Roger Wilcox, Fort Lauderdale, FL (US); Scott A. Wilcox, Plantation, FL (US); Michael J. Gatlin, Cooper City, FL (US); Roberto M. Suarez, Miami, FL (US); John T. Hall, III, Ft. Lauderdale, FL (US)

(73) Assignee: Tigress Trading Co., Inc., Ft. Lauderdale, FL (US)

( * ) Notice: Subject to any disclaimer, the term of this patent is extended or adjusted under 35 U.S.C. 154(b) by 0 days.

(21) Appl. No.: 10/801,275

(22) Filed: Mar. 16, 2004

(65) Prior Publication Data

US 2004/0206288 A1 Oct. 21, 2004

Related U.S. Application Data

(60) Provisional application No. 60/455,982, filed on Mar. 19, 2003.

(51) Int. Cl.
*A01K 97/10* (2006.01)
*B63B 35/14* (2006.01)

(52) U.S. Cl. ..... 43/21.2; 114/255; 248/514

(58) Field of Classification Search ..... 114/255, 114/343, 364; 43/18.1 R, 19.2, 21.2, 27.2, 43/27.4; 248/514–516
See application file for complete search history.

(56) References Cited

U.S. PATENT DOCUMENTS

| | | | | |
|---|---|---|---|---|
| 4,803,938 | A * | 2/1989 | Sergeant | 114/39.3 |
| 4,993,346 | A * | 2/1991 | Rupp | 114/255 |
| 5,592,893 | A * | 1/1997 | Jordan et al. | 114/255 |
| 5,738,035 | A * | 4/1998 | Rupp, II | 114/255 |
| 5,778,817 | A * | 7/1998 | Rupp | 114/255 |
| 6,053,122 | A * | 4/2000 | Jordan, III | 114/255 |
| 6,668,745 | B2 * | 12/2003 | Slatter | 114/255 |
| 6,766,757 | B1 * | 7/2004 | Tilley | 114/255 |
| 2004/0244268 | A1 * | 12/2004 | Slatter et al. | 43/27.4 |
| 2005/0056751 | A1 * | 3/2005 | Slatter | 248/288.11 |

* cited by examiner

*Primary Examiner*—Ajay Vasudeva
(74) *Attorney, Agent, or Firm*—Frank J. Benasutti

(57) ABSTRACT

An outrigger holder for mounting on the top of a T-Top configured boat, has a bearing mechanism mounted above the T-Top designed to relieve most of the weight of the outrigger when turning the holder and outrigger to alternate positions.

3 Claims, 26 Drawing Sheets

T-TOP OUTRIGGER HOLDER APPARATUS

CROSS REFERENCE TO RELATED APPLICATIONS

This application claims the benefit of the filing date of our prior co-pending provisional application No. 60/455,982, filed Mar. 19, 2003, the disclosure of which is incorporated herein by reference as if fully set forth.

BACKGROUND OF THE INVENTION

1. Technical Field

This invention relates to fishing equipment and, more particularly, to an outrigger holder apparatus for use in association with boats fitted with so-called "T-tops".

2. Description of the Prior Art

In the prior art of sport fishing equipment, it is known to use outriggers to play out trolling lines away from the sides and back of the boat. These outriggers can be moved in line with the hull and in-board of the boat when they are not being used for trolling. Thus, they are adjustable between the trolling position and the storage position.

These outriggers can be mounted on bases which are either fixed to the gunnels or tops of the boats or are fixed and adjustable, in that the outrigger can be swung out outwardly to a second fixed position.

Prior art outriggers are shown in U.S. Pat. Nos. 2,927,754, 3,008,259, 3,161,390, 3,190,594, 3,724,791, 5,445,102, and 5,592,893. These patents also show the holders for the outriggers. Many of these patents disclose two means of adjustment: one means of rotating the outrigger holder to move it in a horizontal plane and another means of angling the outrigger holder in a vertical plane.

On a boat which has a T-top, it is desirable to have an outrigger mounted on top of the T-top, while having its control mechanism mounted below the T-top. Outriggers specifically designed for T-top boats are shown in U.S. Pat. Nos. 4,993,346, 5,738,035 and 5,778,817. One of the problems presented by these devices is the awkwardness and strength needed in operating them. For example, in the '346 patent, when the fisherman using the device wishes to rotate the outrigger, he will grab the lever 170 in one hand and push upwardly with his other hand on the extension of the lever member. This is done to retract the plunger from the bore, enabling the tubular element in turn to move the outrigger into another position.

In addition, the "T" Top construction of the boat is generally made of a light weight, somewhat flimsy tubing. Thus it is desirable to provide a strengthening support to tie in the tubing and provide a more rigid support for the outrigger holder.

SUMMARY OF INVENTION

We have invented an outrigger holder which is easy to manipulate to move the outrigger held thereby from inboard to outboard positions and back; all from under the cover of a T-top boat. This ease of movement is provided by a new structure which eliminates having the weight of the outrigger borne by the indexing means.

DESCRIPTION OF THE PREFERRED EMBODIMENTS

Figure 1:
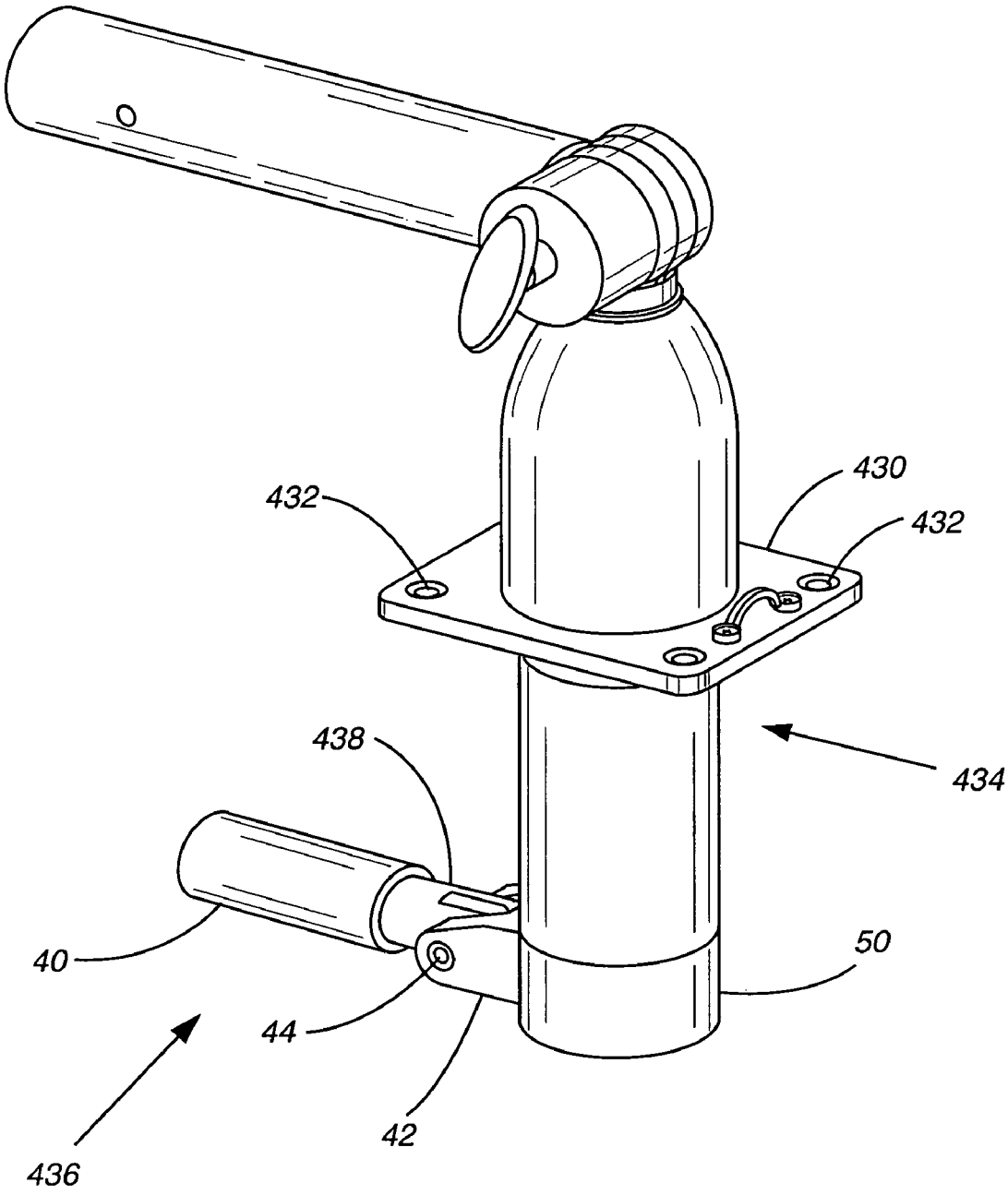
FIG. 1 is a perspective view of an adjustable T-top outrigger holder apparatus in accordance with our invention.
Figure 3:
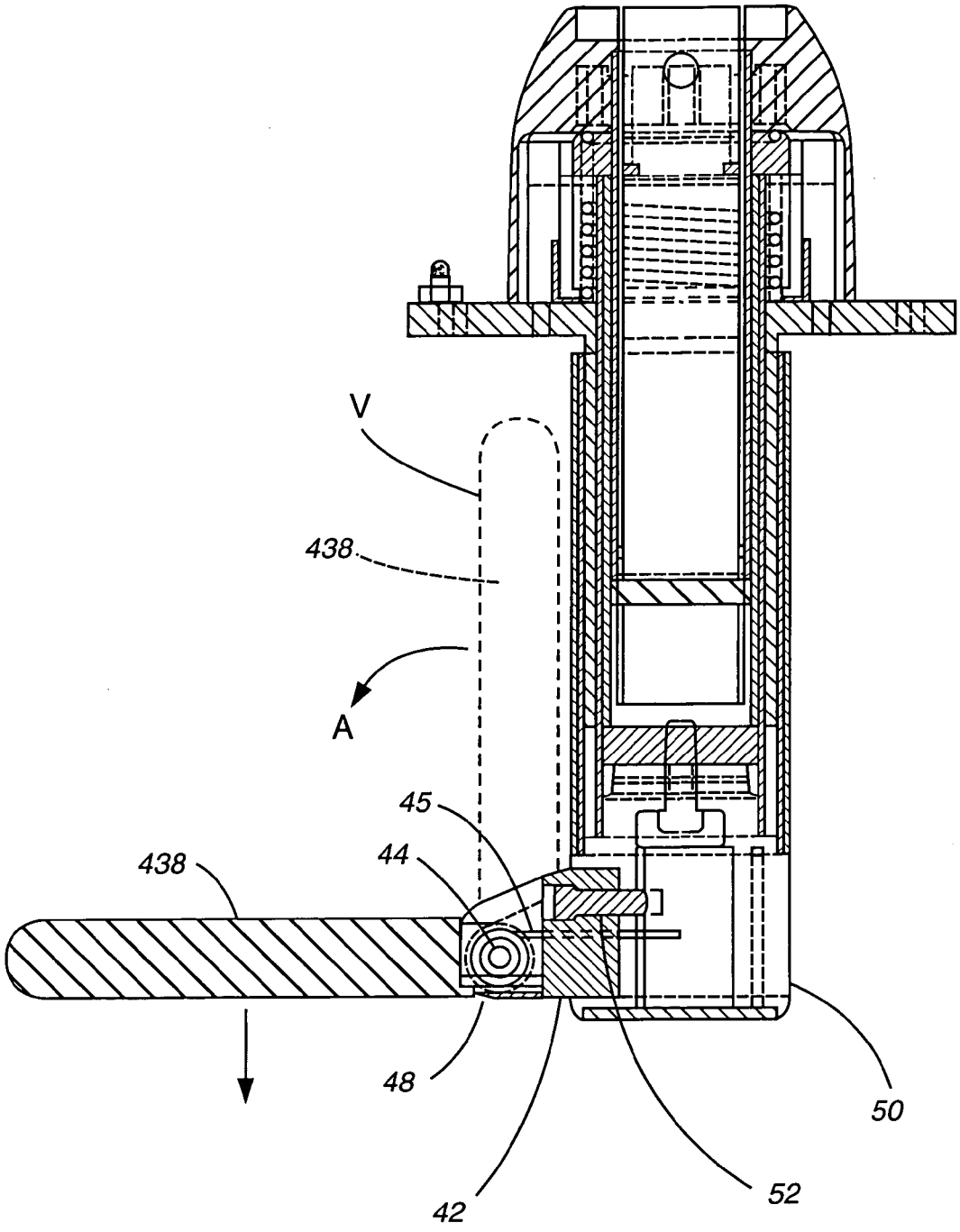
FIG. 3 is an elevation in section of a portion of one embodiment of an apparatus as shown in FIG. 1.
Figure 4:
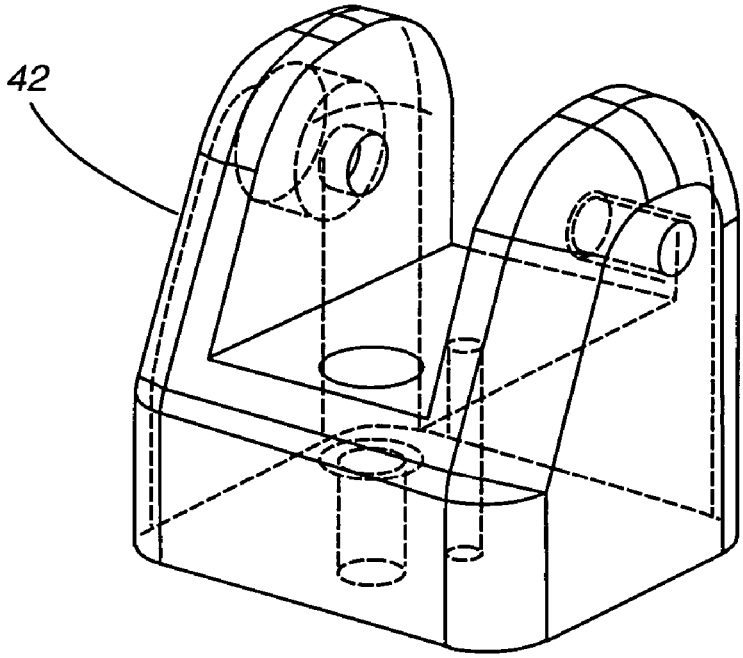
FIG. 4 is an enlarged perspective view of a portion of the apparatus shown in FIG. 3.
Figure 5:
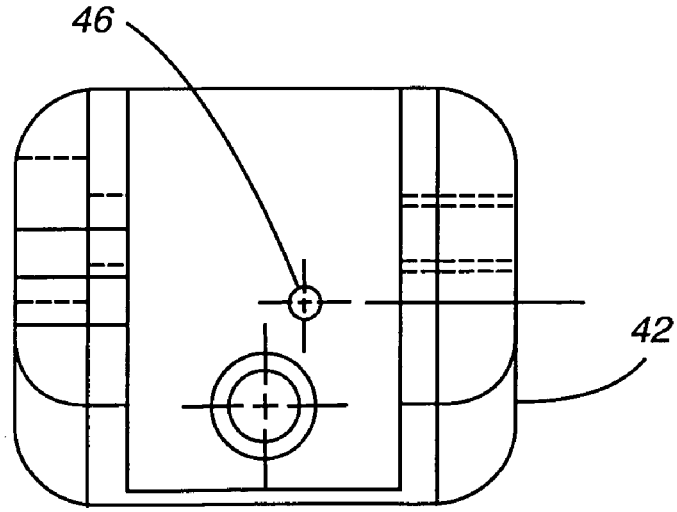
FIG. 5 is an end view of the portion of the apparatus shown in FIG. 4.

Referring to the Figures, FIG. 1 shows a perspective view of an apparatus in accordance with our invention which comprises a mounting plate 430 suitable for mounting on top of a T-top on a boat. The four mounting holes 432 shown at the corners are for receiving bolts. The lower portion designated generally 434 would be positioned below the T-top. The handle means designated generally 436 comprises a handle portion 438 and a resilient handle gripping cover 40. The handle is mounted in a hinge block 42 by means of a bolt 44. The handle is spring-biased, so as to rotate about the bolt to a vertical position "V" shown in phantom lines in FIG. 3. It can then be moved in the direction of the arrow A to its furthest extreme in the position shown in full lines in FIG. 3, wherein the bottom of the handle butts up against the hinge block 42 and prevents further rotation. The biasing spring 45 engages in the hole 46. The spring is wound about the bolt 44 and is connected to, or otherwise retained against, the wall 48, FIG. 3, of the handle to create a spring biasing the handle to the vertical position.

Figure 7:
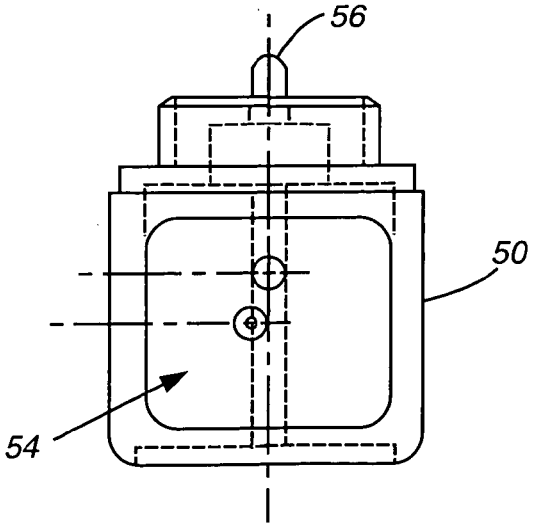
FIG. 7 is an end view of the portion of the apparatus shown in FIG. 6.
Figure 8:
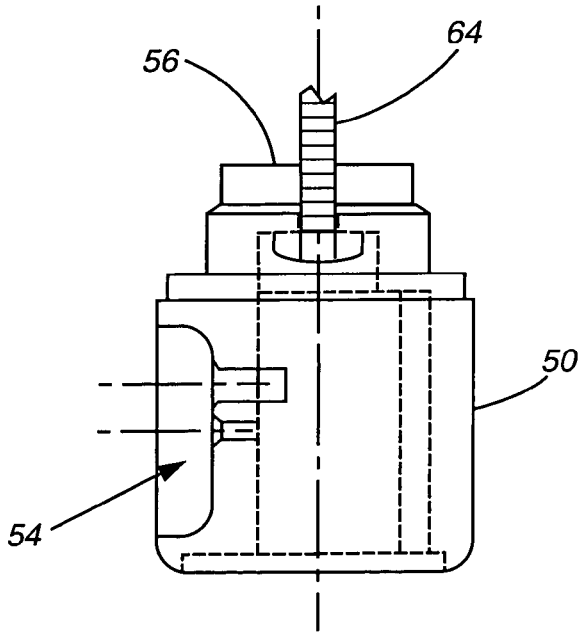
FIG. 8 is a side view of the portion of the apparatus shown in FIG. 7.

The hinge block 42 is retained against the handle block 50 by means of a bolt 52. The hinge block fits into a correspondingly-shaped slot or recess designated generally 54, FIG. 7, in the handle block 50, so that it is retained against rotation. When the handle is rotated horizontally about the longitudinal axis of the handle block 50, that block will rotate.

Figure 6:
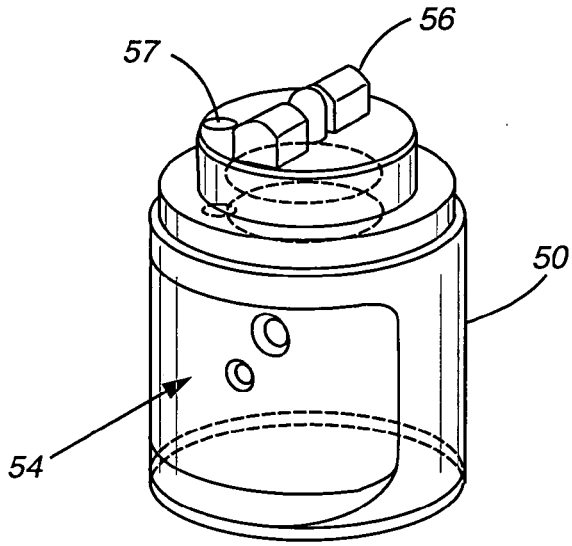
FIG. 6 is a perspective view of a portion of the apparatus which mates to that portion shown in FIG. 4.
Figure 9:
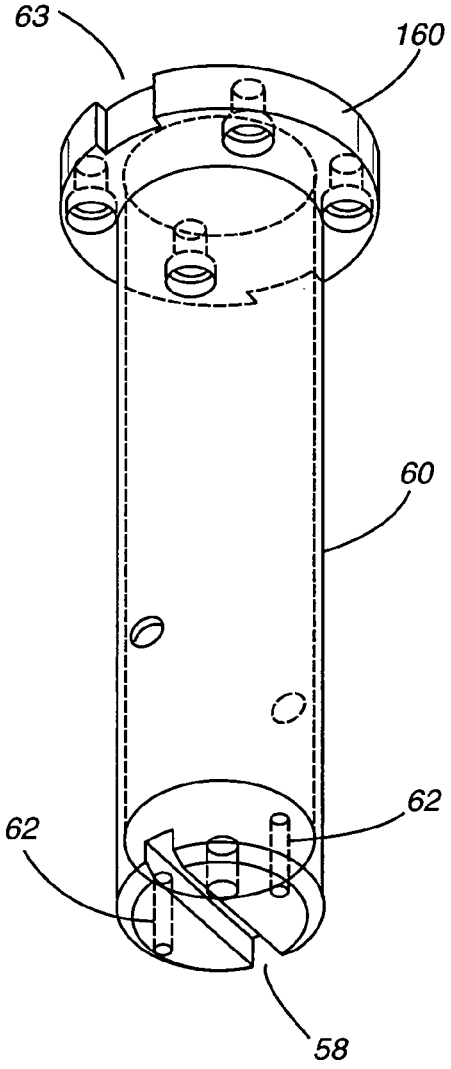
FIG. 9 is a perspective view of another portion of the apparatus.

On the upper end of the handle block 50, there is a key 56 designed to mate with the key way 58, FIG. 9, in the rotating lock means 60. Thus, rotation of the handle and handle block 50 will cause rotation of the rotating lock 60 about its longitudinal axis in the assembled condition. Drain holes are provided in the rotating lock 60 at 62 and in block 50 at 57, FIG. 6.

The rotating lock 60 is retained against the handle block 50 by means of a bolt 64 passing therethrough.

Figure 12:
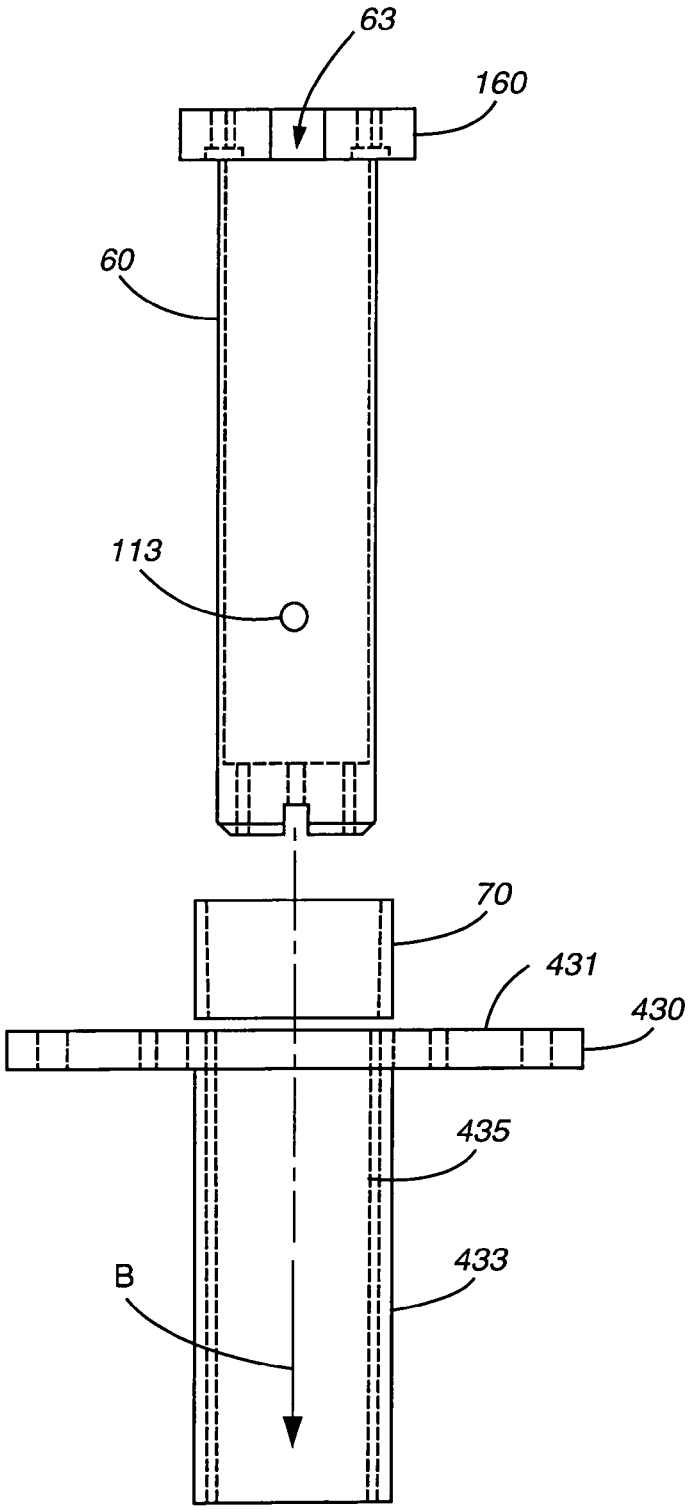
FIG. 12 is an exploded, elevation view of a portion of an embodiment of the apparatus.

The rotating lock 60 is disposed within and through a mounting plate 430. As shown by the exploded view in FIG. 12, it is in juxtaposition in the direction of the arrow B with the cup 70 and the cylindrical portion 433. Most preferably, a plastic material, such as Delrin, is used in a bushing 435, which is provided within the vertically depending cylindrical portion 433 to provide a bearing surface for the outer cylindrical surface of the lock means 60.

Figure 14:
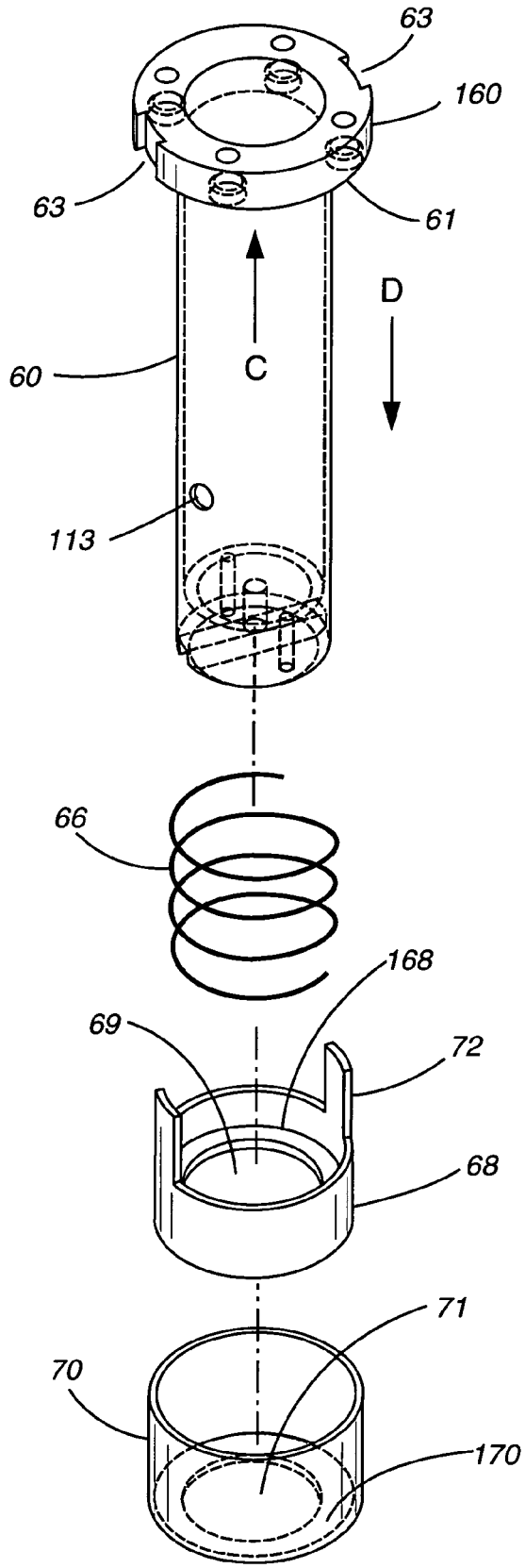
FIG. 14 is an exploded view, partially in elevation and partially in perspective, of a portion of an apparatus as shown in FIG. 1.

Mounted about the rotating lock 60 is coil spring 66, FIG. 14.

Figure 10:
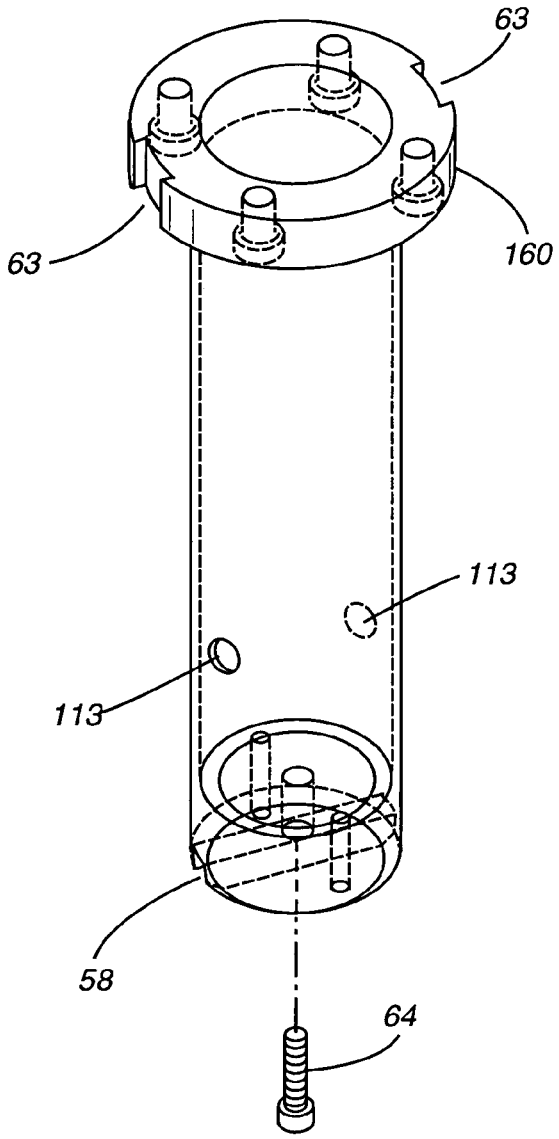
FIG. 10 is an exploded, perspective view of that portion of the apparatus shown in FIG. 9.

This spring is retained within a housing 68. The housing 68 is retained within a cup 70. The cup 70 normally is seated upon the upper surface 431 of the mounting plate 430; see FIG. 12. The rotating lock 60 passes through the hole 69 in the housing 68 (FIG. 14) and passes through the hole 71 in the cup 70. The housing 68 sits against the inside surface 170 of the cup 70 and the spring 66 rests on the inside surface 168 of the housing 68. The other end of the spring presses against the under surface 61 of the horizontally-extending top flange portion 160 of the rotating lock means 60. When the rotating lock is retracted vertically downwardly in the direction of the arrow D, FIG. 14, the underside 61 of the top flange portion 160 of the lock 60 engages the spring 66 and compresses it. Thus, the lock 60 is spring-biased vertically upwardly from the mounting plate 30 in the direction of the arrow C shown in FIG. 14. The vertically extending diametrically opposed ears 72 of the housing 68 extend within the correspondingly positioned slots 63 (See FIGS. 9 and 10) in the horizontally extending top flange 160 of the rotating lock 60.

Figure 15:
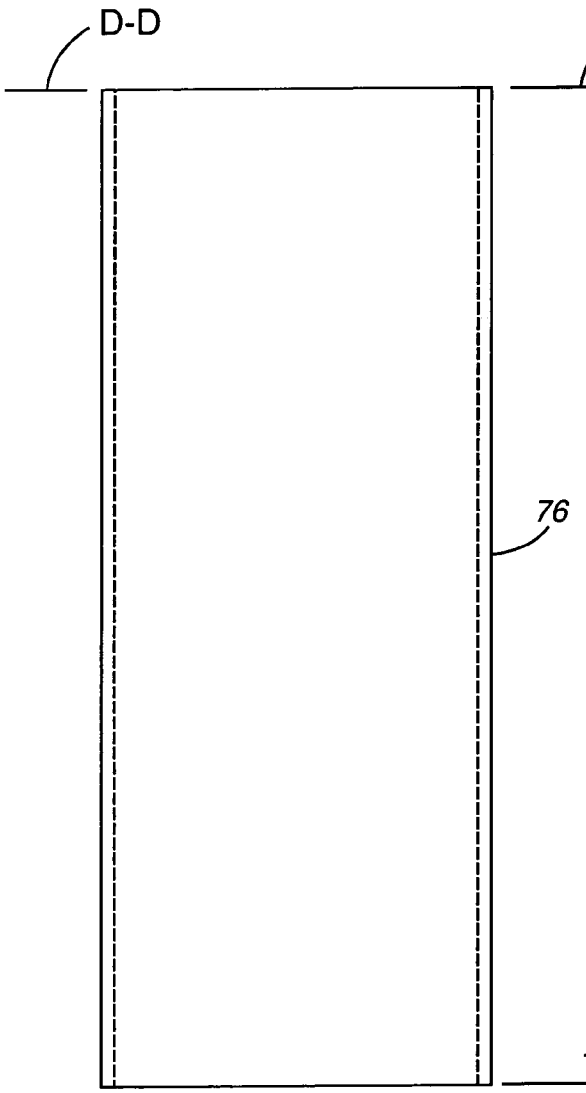
FIG. 15 is a side elevation of a portion of an apparatus as shown in FIG. 1.
Figure 16:
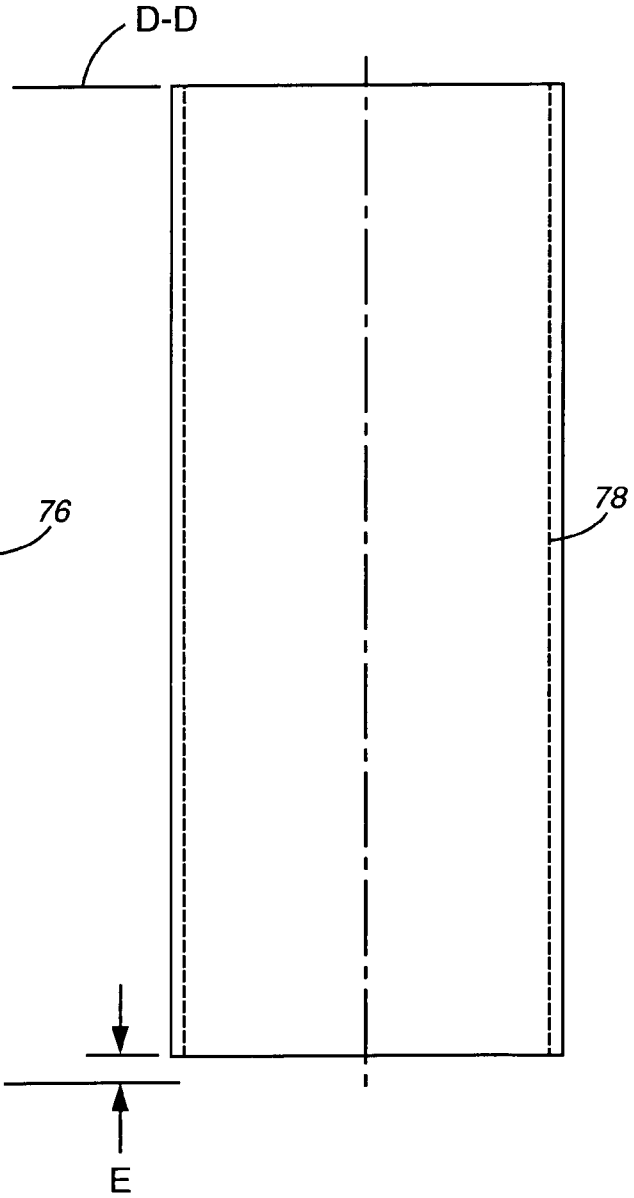
FIG. 16 is a side elevation of a portion of an apparatus which fits into that portion shown in FIG. 15.
Figure 17:
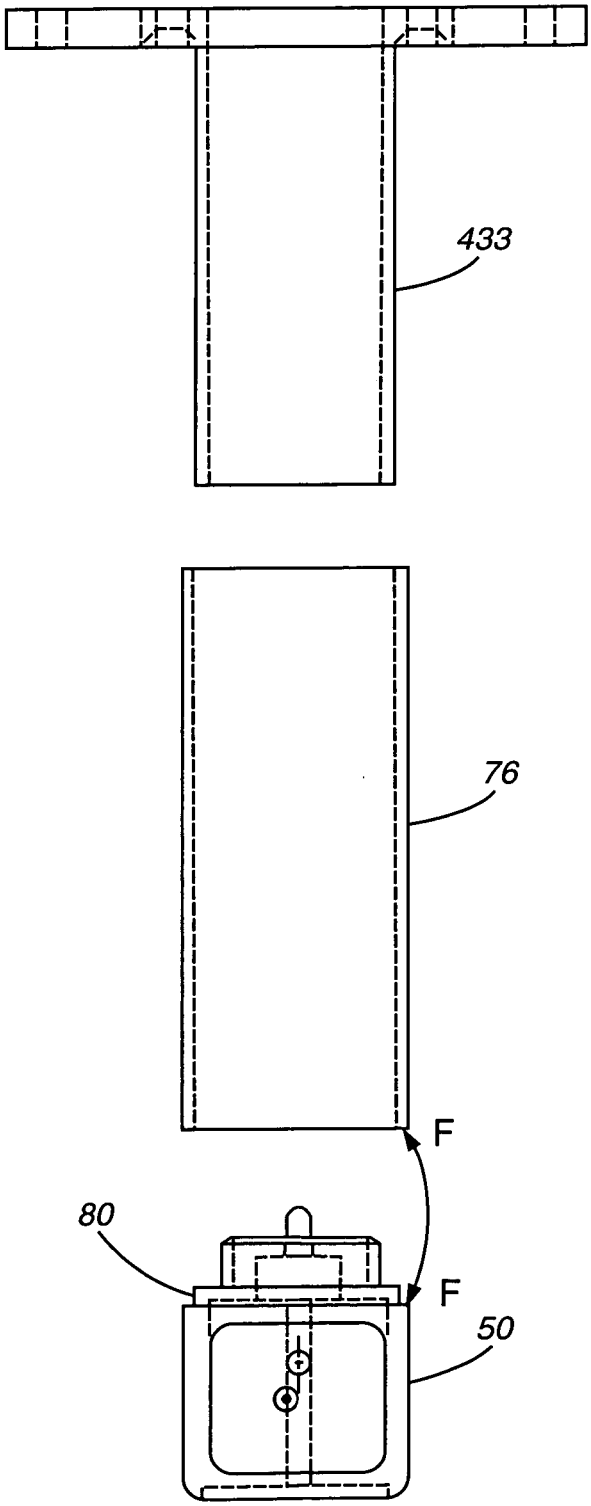
FIG. 17 is an exploded view of a portion of an apparatus as shown in FIG. 1.

Mounted about the depending cylindrical portion 433 of the mounting apparatus is an outer cylinder 76, FIGS. 15 and 17. Outer cylinder 76 is welded to block 50 at the seam (butt joint) designated as F—F. This fixes these two pieces together, thereby removing a finger pinch hazard. Pressed fit within this cylinder 76 is a cylindrical sleeve 78, FIG. 16, made of a plastic material, such as, Delrin. The press fit is such that the part 78, FIG. 16 is even at the top as at D—D in FIGS. 15 and 16; and thus, because of its length, it will be shorter on the inside as at E in comparing FIG. 16 to FIG. 17. Therefore, when the parts are assembled, the part 76 will fit on top of the part 50, FIG. 17, and will embrace the upstanding shoulder 80. At the same time, the inner plastic sleeve 78 will rest upon the shoulder 80, FIG. 17. The parts are shown in exploded view in FIG. 17.

Figure 19:
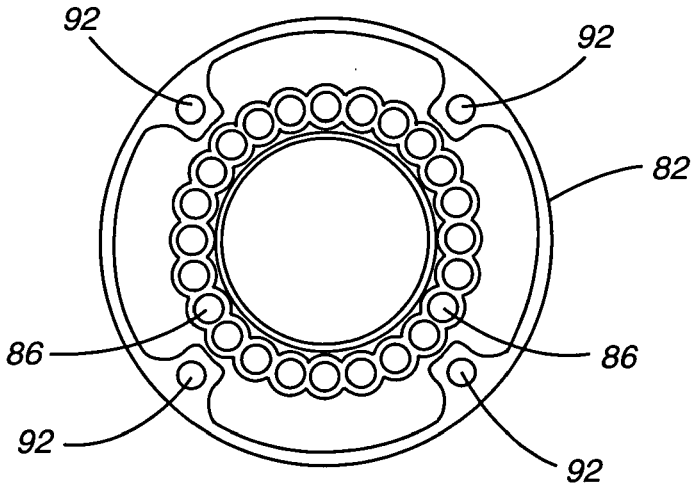
FIG. 19 is a perspective view of a portion of an apparatus as shown in FIG. 1.

An upper housing 82 is shown in perspective view in FIG. 19. This part is shown in section in the exploded view FIG. 20. In that view, it will be noted that the upper end flange 160 of the rotating lock 60 is positioned to be inserted into the underside of the upper housing 82. Four pins 84 extend through the horizontally extending top flange portion 160 of the rotating lock 60. These pins are designed to engage mating holes, in the upper housing 82; a plurality of which holes are designated generally 86 in FIG. 19. The member 60 is normally into engagement with the upper housing 82.

Figure 11:
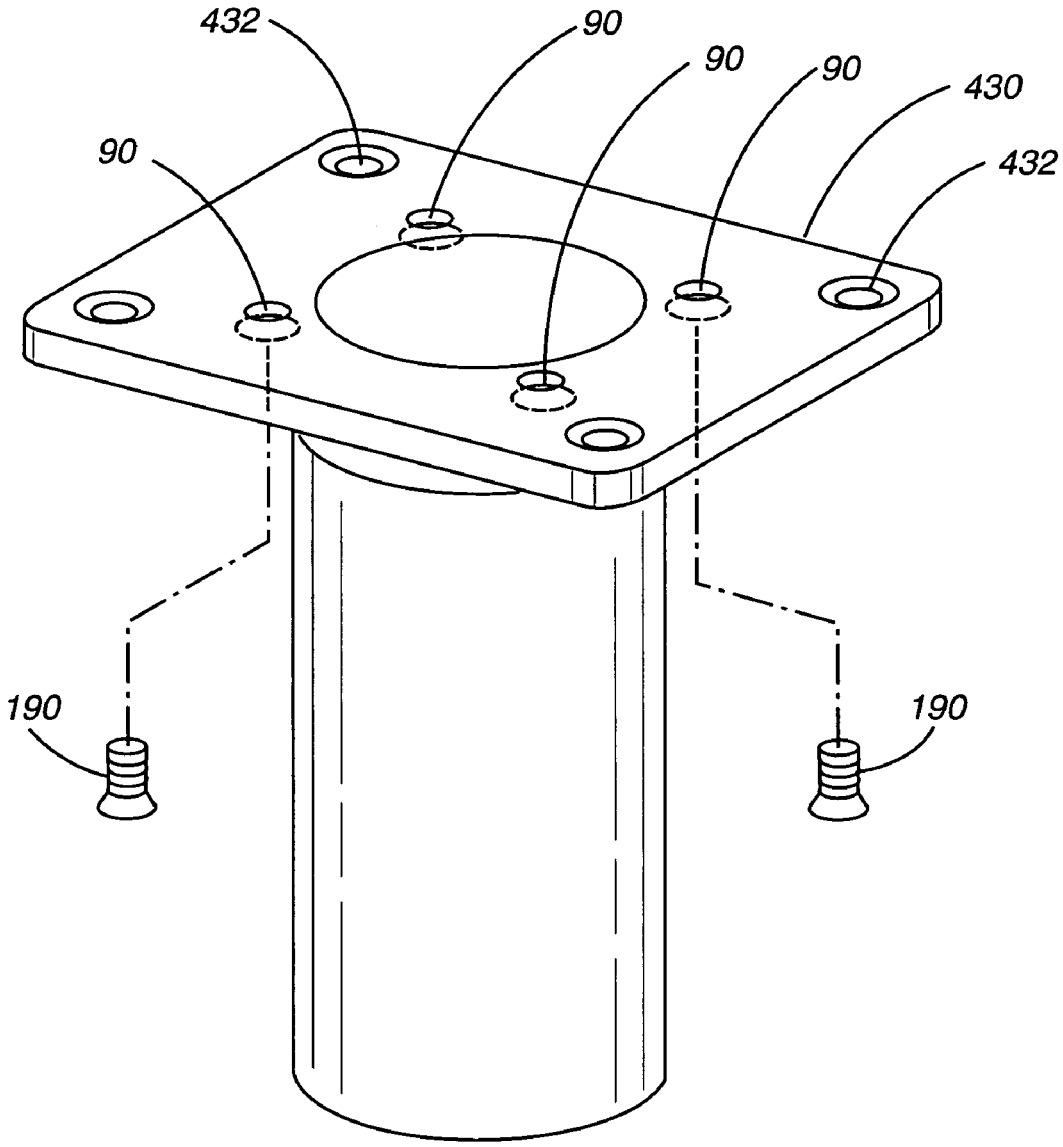
FIG. 11 is aa exploded, perspective view of an embodiment of a T-top mounting portion of an apparatus as shown in FIG. 1.

The housing 82 is retained in fixed relationship to the mounting plate 30 by means of screws 190 passing through the holes 90, FIG. 11, from the under side of the plate 30 and into the threaded holes 92, FIG. 19. Thus, when the pins 84 engage the holes 86, the rotating lock 60 cannot be rotated. This is its normal, at rest condition.

Figure 21:
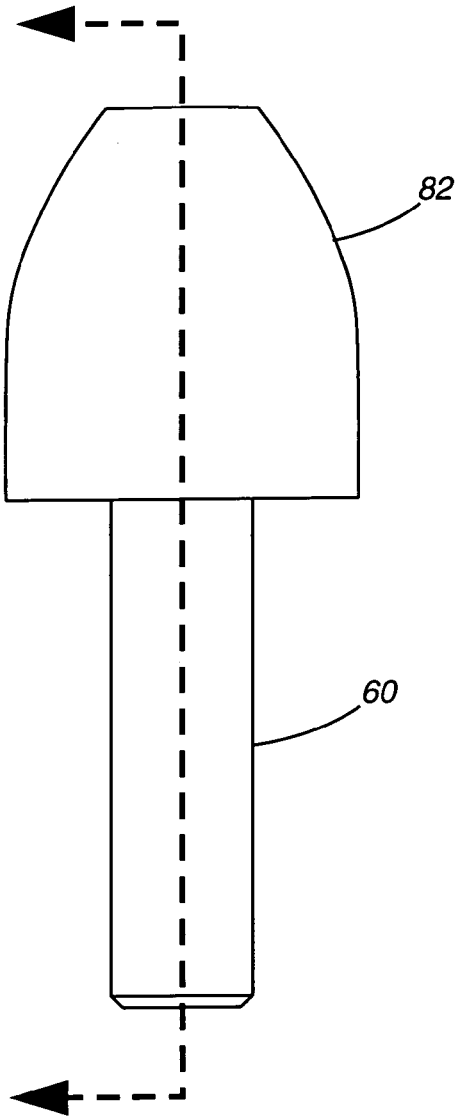
FIG. 21 is a side elevation of a portion of an apparatus as shown in FIG. 1.
Figure 22:
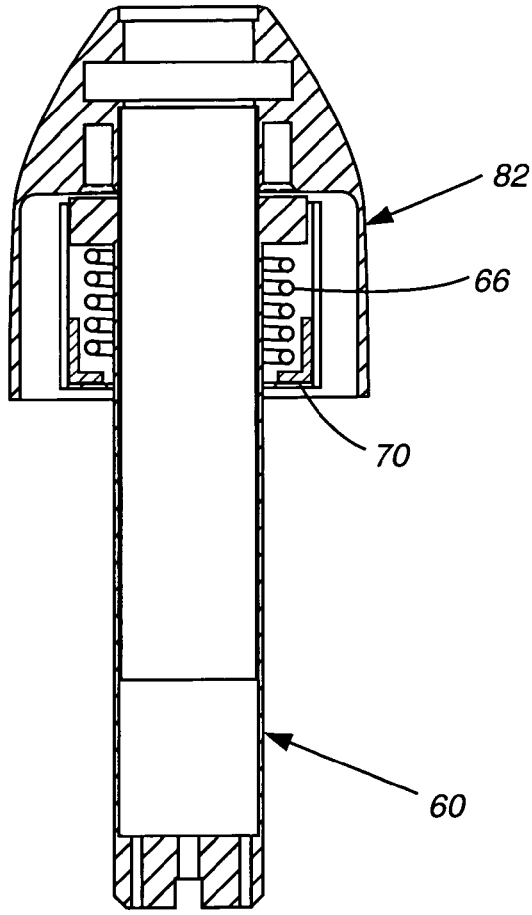
FIG. 22 is a full section of the portion of the apparatus shown in FIG. 21.

Referring to FIGS. 21 and 22, these parts 60 and 82 are shown in vertical elevation and section, respectively.

From what has been described, we have provided a means to draw the member 60 downwardly so as to disengage the pins 84 from the holes 86. This is accomplished by pulling down on the handle 38 from its vertical position to its horizontal position; and then, continuing to exert a downward pull, so that the lock means moves downward a sufficient distance to disengage the pins 84 from the holes 86.

In this condition, the lock means 60 can be rotated by moving the handle 38 in a horizontal plane.

When one stops exerting a downward force on the handle, the force of the spring 66 takes over and moves the lock upwardly to a position for re-engagement of the pins 84 with the holes 86.

Figure 29:
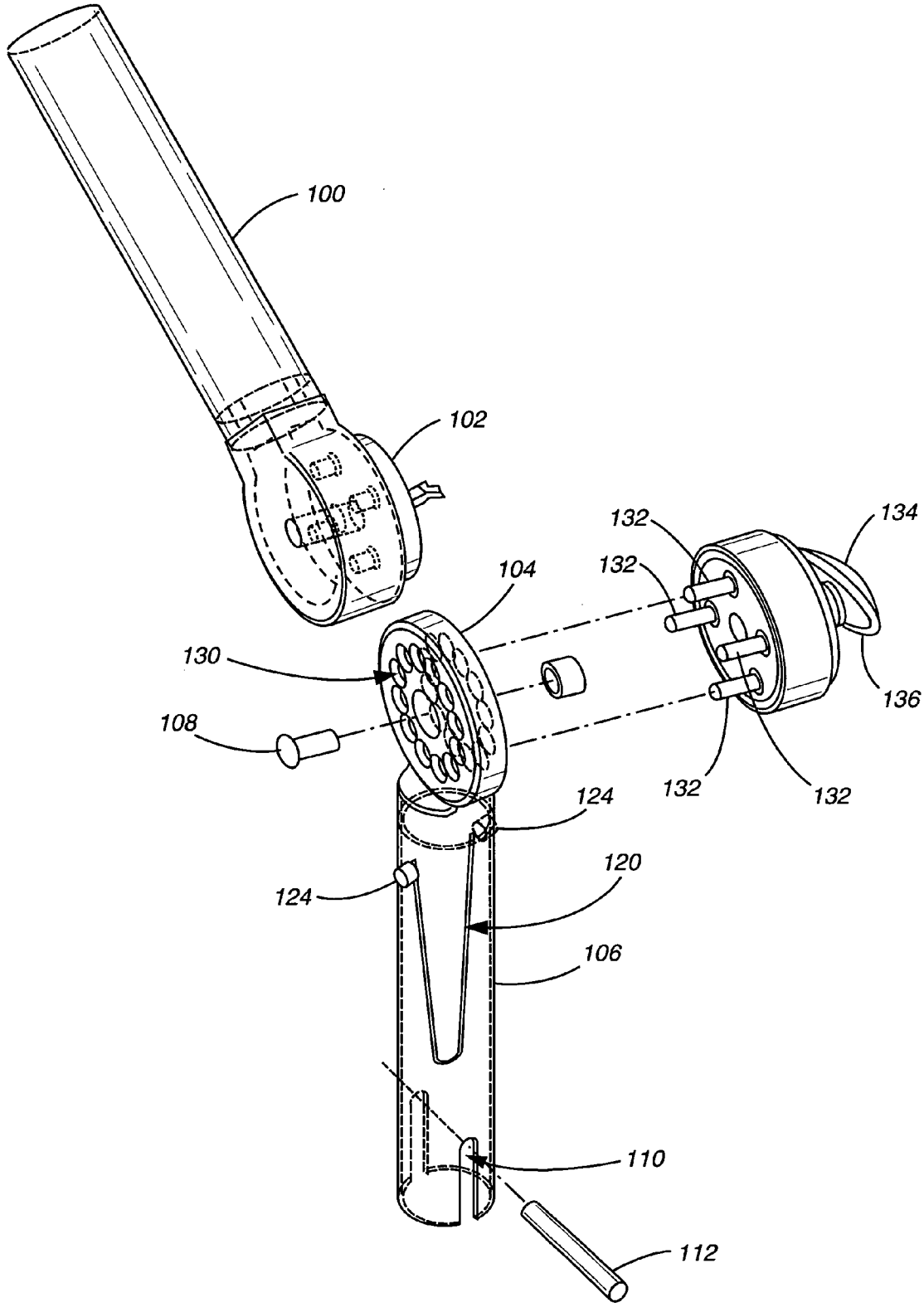
FIG. 29 is an exploded perspective view of a portion of an apparatus.

An outrigger holder is shown in FIG. 29 in exploded view. It comprises a tube assembly 100 terminating in a clevis portion 102, which embraces the disk-shaped terminal portion 104 of the outrigger arm insert 106. These parts are retained for relative rotation by the bolt 108. The arm insert 106 has a forked end 110. The forked end is designed to embrace the pin 112, FIG. 25, which is retained in the walls of the rotating lock 60 (by being fitted to holes 113 therein). Thus, in operation, rotation of the part 60 also rotates the outrigger arm insert 106 and the tube assembly 100.

Thus we have provided an indexing means whereby an outrigger holder can be rotated horizontally to move an outrigger inboard or outboard to a plurality of fixed positions.

Figure 28:
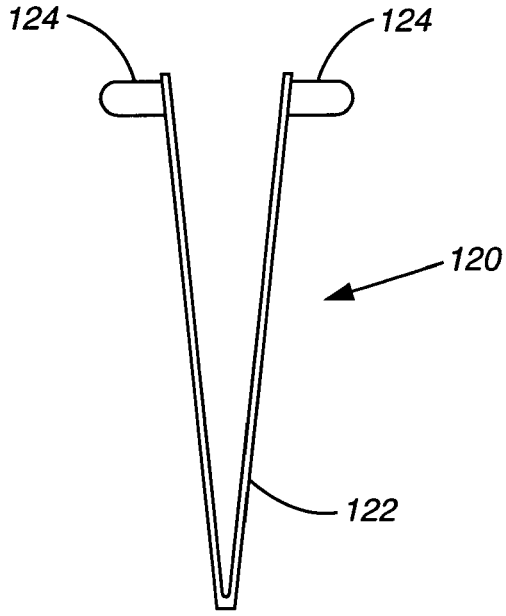
FIG. 28 is a side elevation of a portion of an apparatus.
Figure 23:
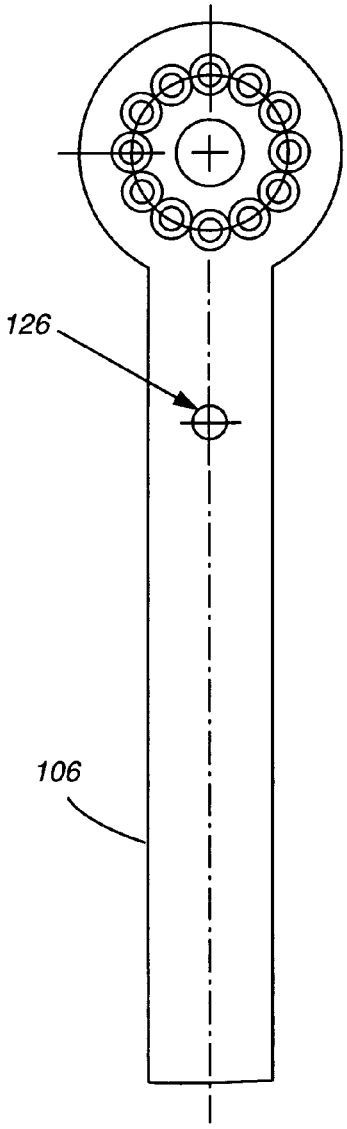
FIG. 23 is a front elevation of a portion of the apparatus as shown in FIG. 1.
Figure 24:
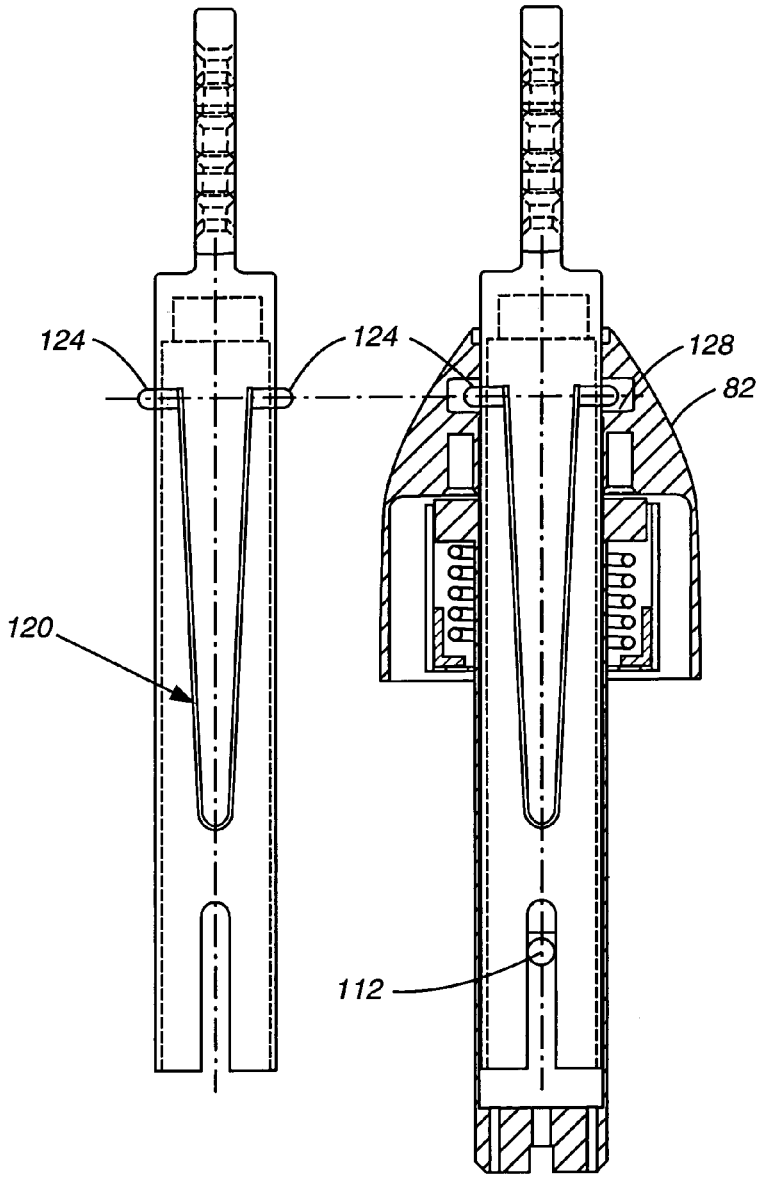
FIG. 24 is a side elevation of the portion shown in FIG. 23, shown partially in section and juxtaposed to that portion of the apparatus shown in FIG. 22.

The spring-loaded retainer bearing means designated generally 120, FIG. 28, comprises a hairpin spring 122 which has a plurality of pins 124 extending from the open ends of the hairpin structure. This spring-loaded retainer bearing means is mounted within the tube 106, as shown in FIGS. 24 and 29 in such a manner that the pins 124 extend through holes 126, FIG. 23, in the insert 106. See FIGS. 23 through 25. These pins 124 fit within the circular slot designated generally 128 in the upper housing 82, FIG. 24 and form a bearing means, such that the member 106 can rotate within the housing 82 while being retained vertically therein. Since the outrigger holder exerts a downward vertical force on the pins 124, those pins will ride on the bottom surface forming the slot 128, FIG. 24 when the outrigger holder is rotated.

In order to adjust the vertical angle of the tube assembly 100, so as to adjust the vertical angle of the outrigger which is mounted therein, a plurality of holes are provided in the disk-shaped terminal portion 104 of the outrigger arm insert 106. These holes designated generally 130, FIG. 29, mate with corresponding pins 132 extending from the pull handle means 134, FIGS, 26, 27 and 29.

Figure 27:
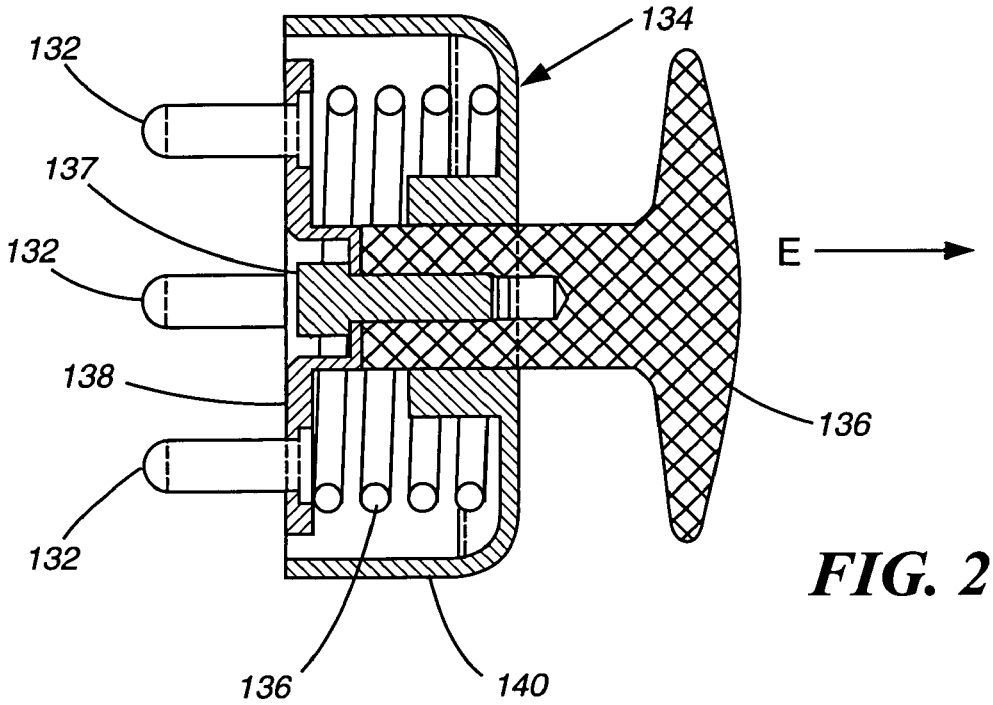
FIG. 27 is a rotated section of the portion of the apparatus shown in FIG. 26.

The pull handle means 134 comprises a handle 136 attached by a screw 137 to a plate 138 in which the pins 132 are mounted; as for example, by welding. A spring 136 is provided biasing the plate 138 outwardly from the housing 140. Thus, when the handle 136 is pulled in the direction of the arrow E, FIG. 27, against the weight of the spring 136, the pins 132 are retracted from the holes 130, FIG. 29. Since the pull handle means housing 140 is fixedly attached to the clevis portion 102, when the pins are thus released from engagement, the handle 136 can be turned; thereby turning the tube assembly 100

Figure 2:
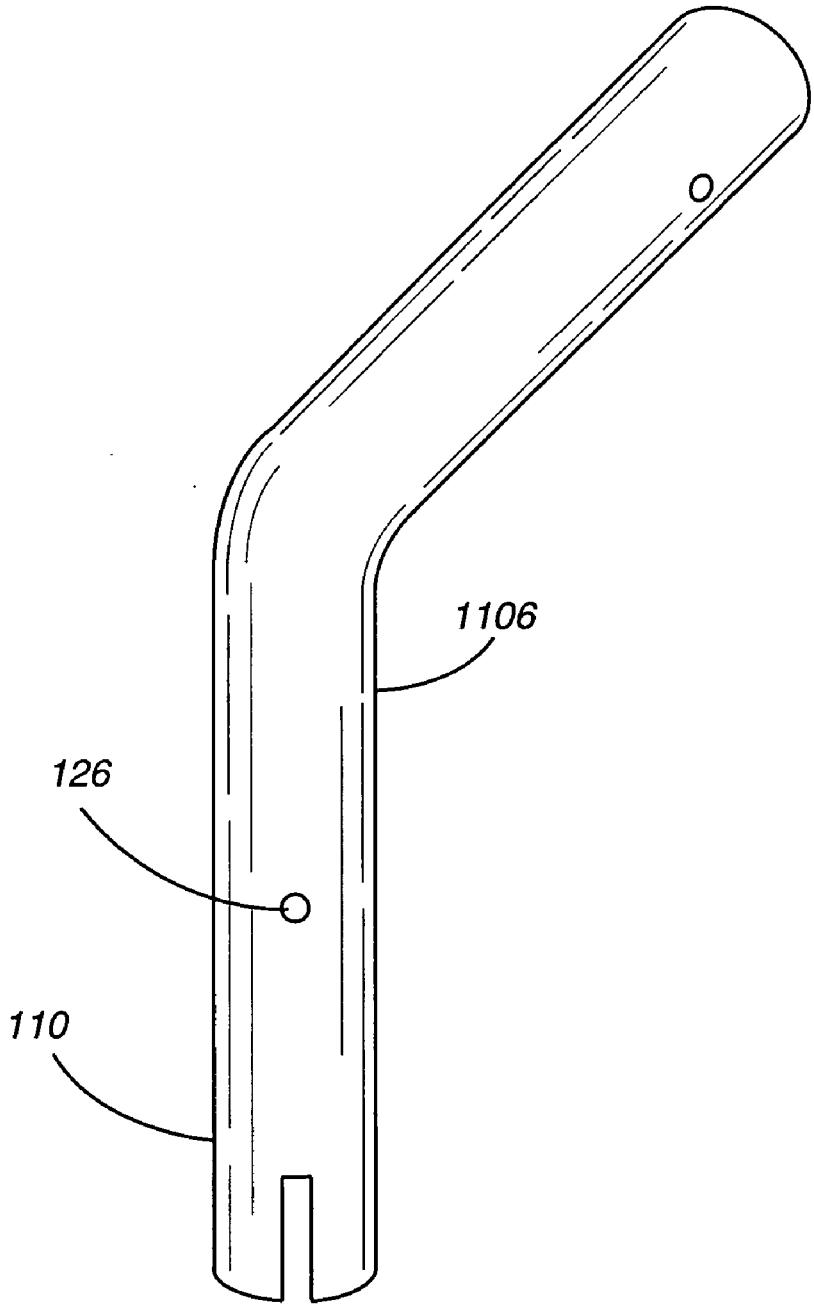
FIG. 2 is a side elevation of a portion of an alternate embodiment of an outrigger holder.

While it will be understood that the tube assembly 100 and the outrigger insert 106 form a vertically adjustable outrigger holder, it is also contemplated within our apparatus to use an outrigger holder that is at a fixed angle; such as that shown in FIG. 2 at 1106. Therein the forked end 110 functions as previously described.

Figure 30:
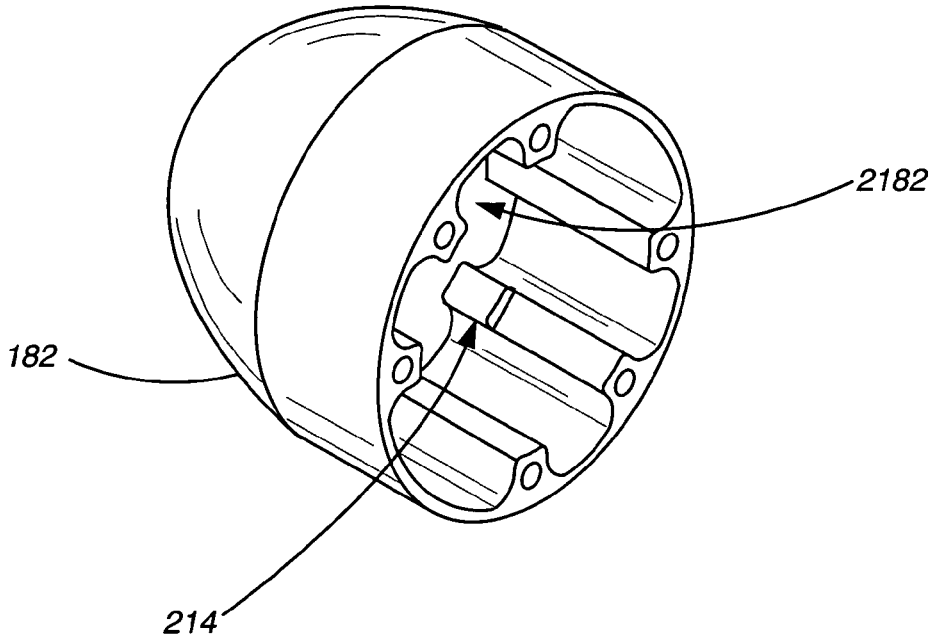
FIG. 30 is a perspective view of a modified portion of our apparatus in accordance with another embodiment of our invention.
Figure 31:
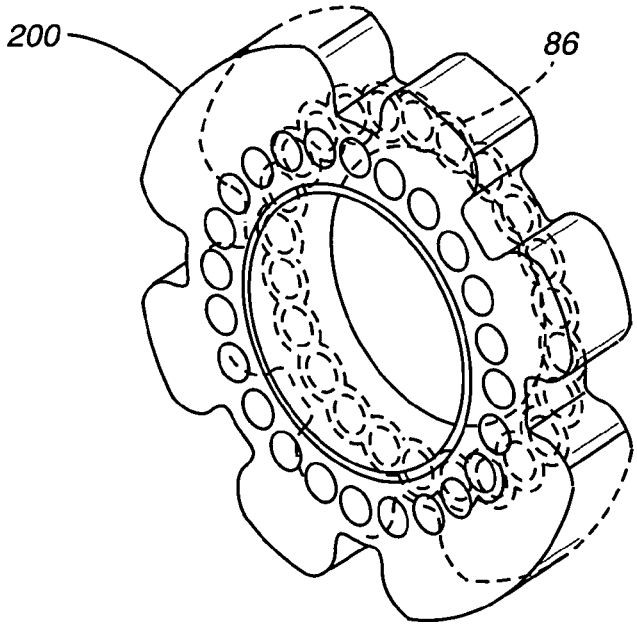
FIG. 31 is a perspective view of a modified portion of our apparatus in accordance with another embodiment of our invention.

In another embodiment of our invention, the ends 1106 and 106 may be retained in an upper housing 182, FIG. 30. This upper housing differs from the upper housing 82, in that the inside has been modified. In particular, that portion of the upper housing 82 which had been pre-drilled with holes 86, has been made into a separate locking plate, 200 FIGS. 31 and 32. This plate is keyed into the inner walls of the housing 182, by its complementary configured outer periphery; which prevents it from being rotated in the assembled condition.

Figure 32:
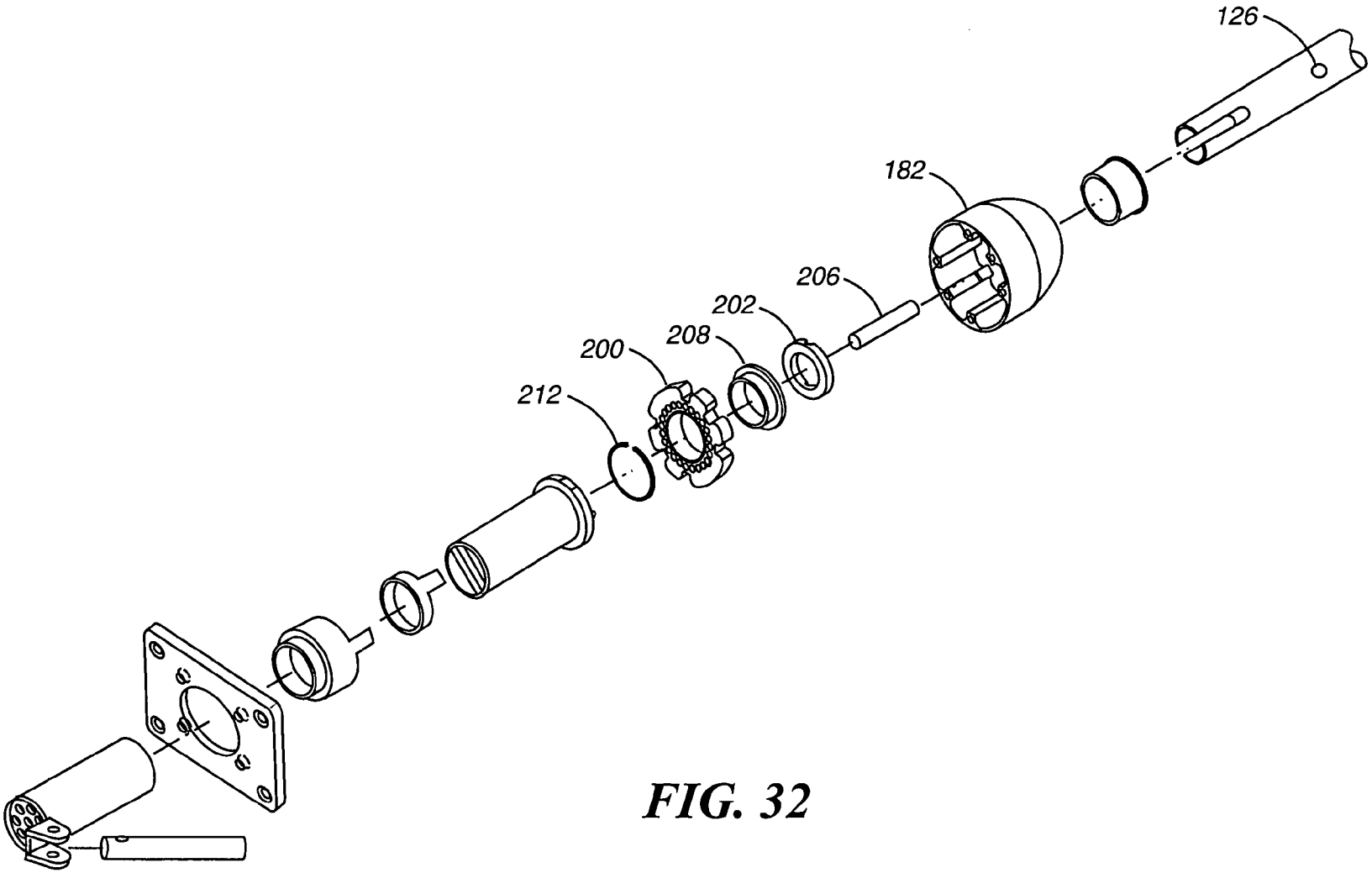
FIG. 32 is an exploded perspective view of a modified portion of our apparatus in accordance with another embodiment of our invention.
Figure 33:
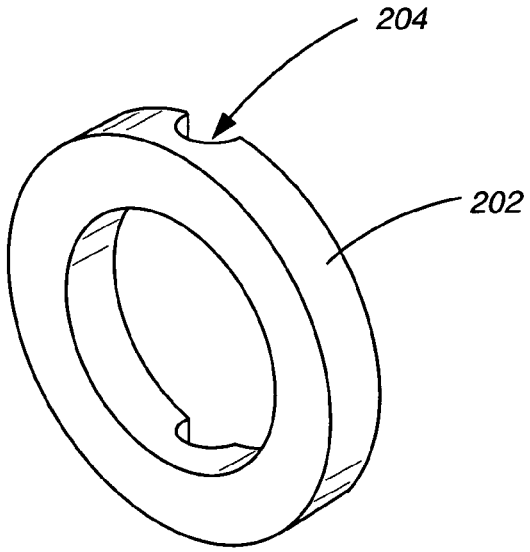
FIG. 33 is a perspective view of a modified portion of our apparatus in accordance with another embodiment of our invention.
Figure 34:
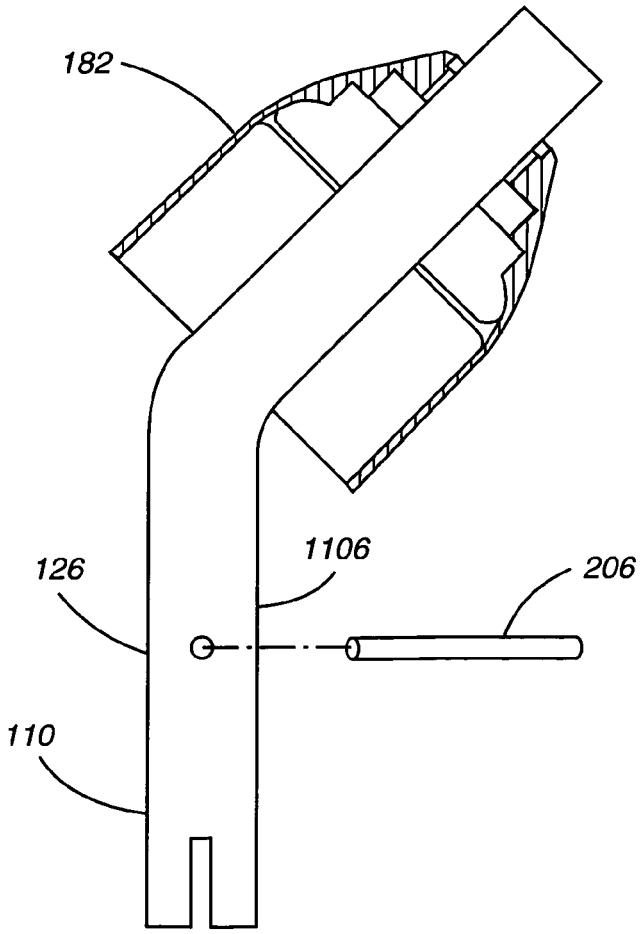
FIG. 34 is an exploded perspective view, partially in section, of a modified portion of our apparatus in accordance with another embodiment of our invention.

A support plate 202, FIGS. 32 and 33 is provided to be assembled between the locking plate 200 and the inside, upper portion designated generally 2182 FIG. 30 of the upper housing 182. A groove, designated generally 204 FIG. 33, is provided along a diameter of the support plate 202 to engage a support pin 206 FIG. 32. The support pin 206 passes through the holes 126 (FIG. 34) in the ends 1106 or 106 and in the assembled condition, the pin 206 functions as a support bearing means for the outrigger holder; when the holder is in a vertical position for use in a boat. To assemble the pin 206 in the holes 126, the tubular section (having the end 1106 or 106) must first be inserted through the upper housing 182 a sufficient distance to expose the holes 126 for insertion of the pin 206. See FIG. 34. Then the tubular section of the outrigger housing can be drawn back in the opposite direction, thereby positioning the pin 206 near the inside upper end 2182 of the housing 182. The support plate 202 is then positioned to engage the pin 206.

Figure 35:
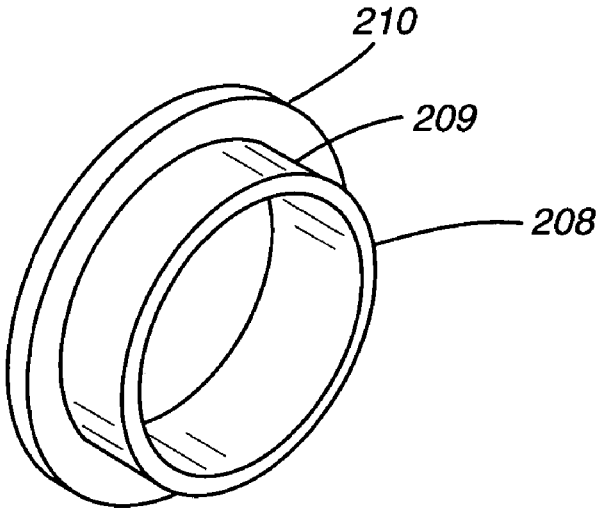
FIG. 35 is a perspective view of a modified portion of our apparatus in accordance with another embodiment of our invention.

A plastic tubular bottom bushing 208 FIG. 35 with a radially extending flange 210 is inserted into the locking plate 200, so that the flange 210 rests against a surface of the plate 200. Thus, when these parts are inserted into the upper housing 182, and the unit is in its operating, vertical position, the support pin 206 will engage the support plate 202 in the groove 204 and the support plate 202 will engage a mating surface of the radially extending flange 210; thus providing a bearing for the weight of the outrigger holder during rotation thereof.

Figure 36:
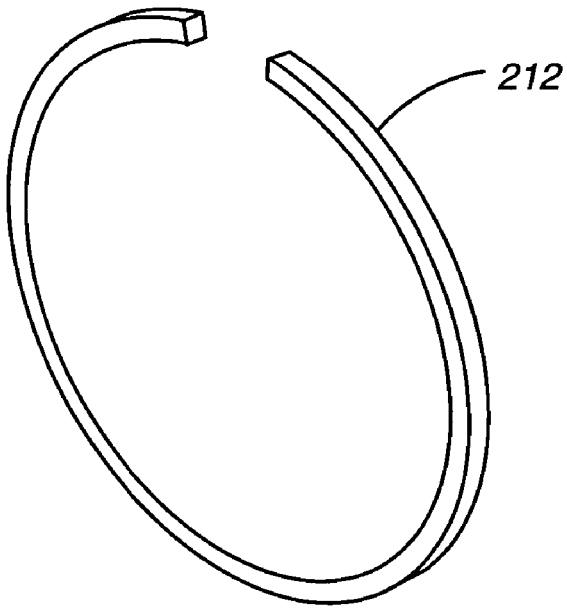
FIG. 36 is a perspective view of a modified portion of our apparatus in accordance with another embodiment of our invention.

The locking plate 200 is retained in the upper housing 182 by means of a snap ring 212 FIGS. 32 and 36 retained in a groove 214, FIG. 30. This construction eliminates the need for the hairpin spring 120.

The downwardly extending bearing portion 209 of the bottom bushing 208 provides a bushing for absorbing the force of the cantilevered outrigger holder bottom 106 or 1106.

Figure 38:
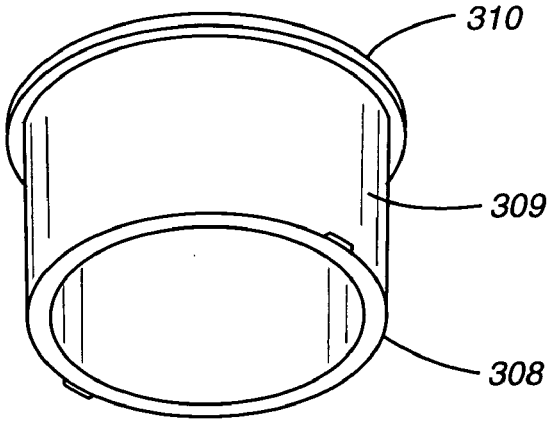
FIG. 38 is a perspective view of a modified portion of our apparatus in accordance with another embodiment of our invention.

A top bushing 308 FIG. 38 has a radially outwardly extending flange 310 and a downwardly extending cylindrical bearing portion 309. It is positioned through the top hole in the upper housing 82 or 182; with the flange 310 resting against the top end of the upper housing. The depending portion of the outrigger holder passes there through. See FIG. 32.

Figure 37:
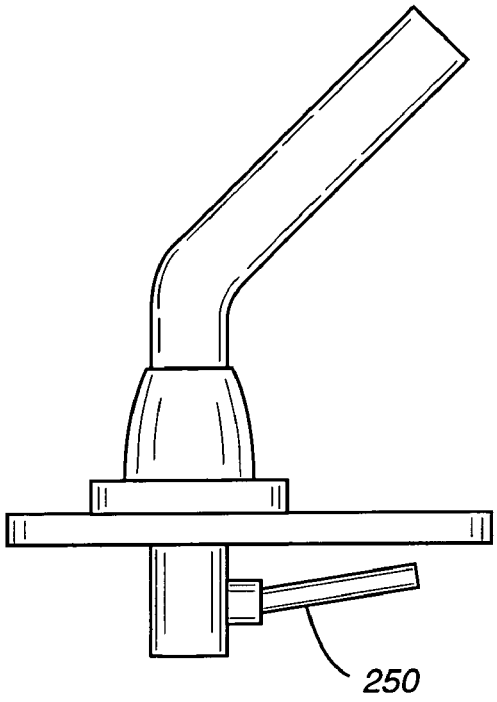
FIG. 37 is a perspective view of a modified portion of our apparatus in accordance with another embodiment of our invention.

There are other alternate structural embodiments, such as the unified hinge, handle block and outer cylinder, 250 FIG. 37; which has a yoke member welded to the cylinder to form a single piece, replacing the separate pieces 42, 50, 76, 78 and 33. As previously described, the cylindrical depending portion 433 was welded to the plate 50. In this embodiment, the part 250 simply butts up against the plate 50.

Figure 13:
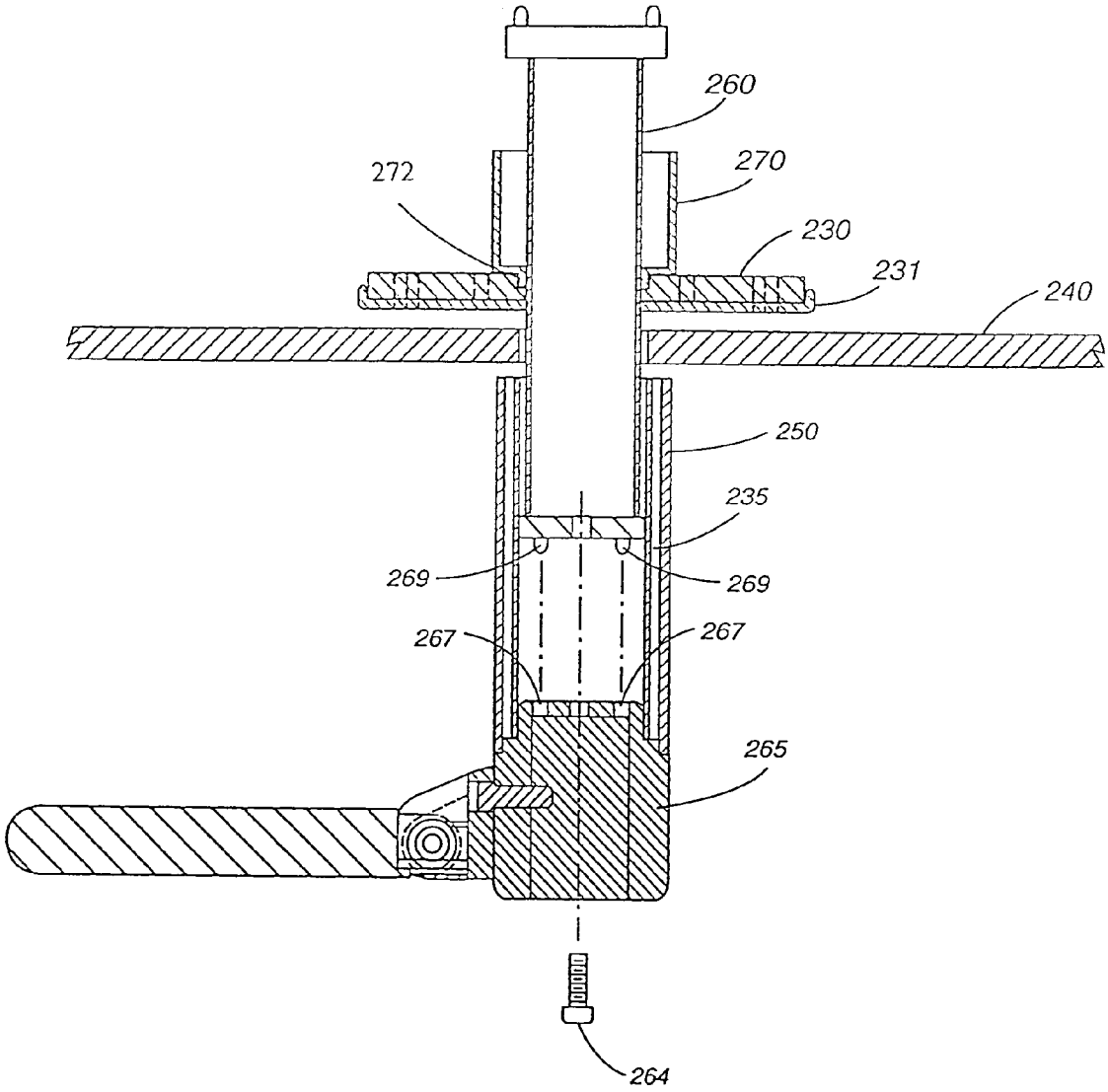
FIG. 13 is an exploded view of a side elevation of portions of an apparatus in accordance with another embodiment of our invention.

The cup 70 FIG. 14 may be replaced in an alternate embodiment with a cup 270 FIG. 13, having a depending cylindrical portion 272; securely fitted into a mating hole in the mounting plate 230.

A flexible gasket 231 made of, for example, rubber, is provided between the plate 230 and a mounting plate assembly 240. The rotating lock means 260 passes through the bearing 272 and is attached to the outer sleeve portion 250 by means of a bolt 264 which is threaded thereto and retained against a bracket 265. The bracket 265 is retained in the sleeve 250 by any suitable means, such as being press fit therein. The bracket 265 has a plurality of holes 267 therein to receive the pins 269. Thus, when the bolt 264 is tightened, the pins 269 in the holes 267 prevent rotation of the lock means 260 with respect to the sleeve 250.

An inner plastic sleeve bearing 235 is provided between the sleeve 250 and the lock means 260.

Figure 39:
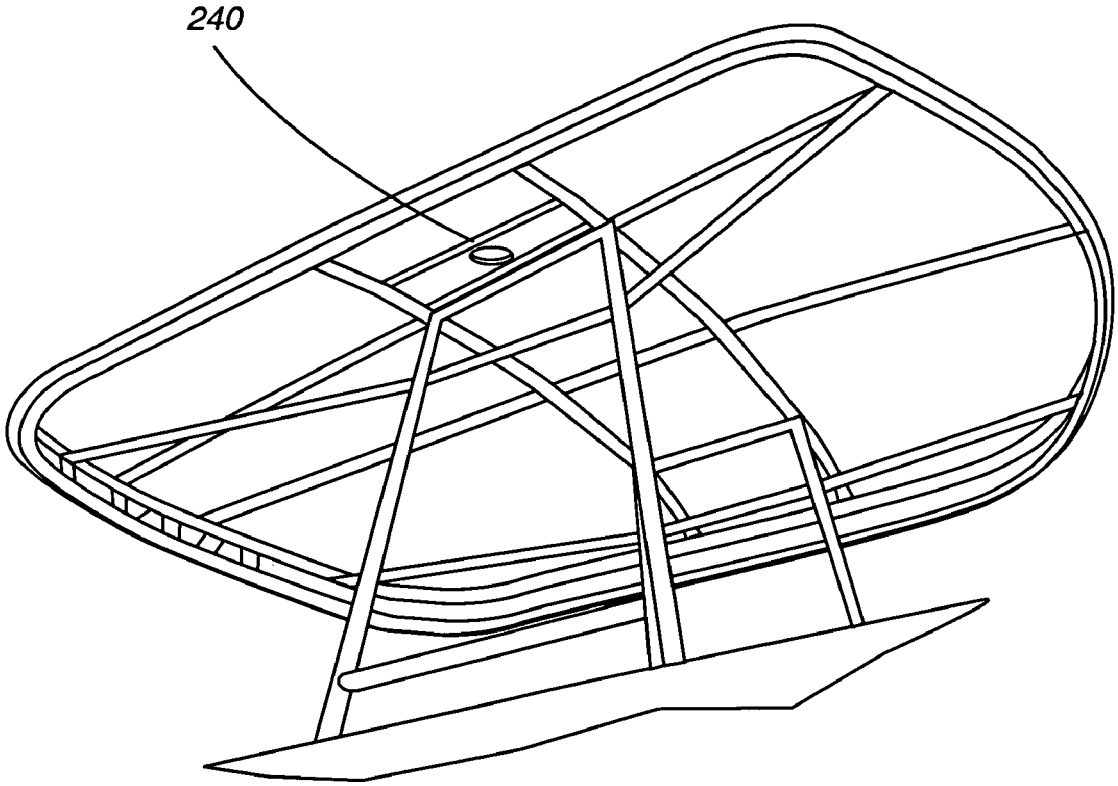
FIG. 39 is a perspective view of a T-top with a mounting plate assembly.

The mounting plate assembly 240 is shown in perspective view in FIG. 39. This plate is an extrusion which, in use, is welded to the frame designated generally 241 of the T-top of the boat to provide rigidity to the overall structure and a stable place to mount the outrigger holder assembly.

OVERVIEW OF THE INVENTION

To get a perspective on the invention, it comprises an indexing means for mounting an outrigger holder on top of a structural part of a boat and for adjusting the position of that holder to a plurality of fixed positions in a horizontal plane. This adjustment is made from underneath the structural part of the boat, upon which the holder is mounted. To make this adjustment practicable, a bearing means is provided to take the weight of the holder and the outrigger positioned therein, while the holder is being indexed to another fixed position.

The outriger holder is shown in FIG. 29 and comprises a depending part 106 for mounting in the mounting means. An alternate version of a holder 1106 is shown in FIG. 2.

Figure 18:
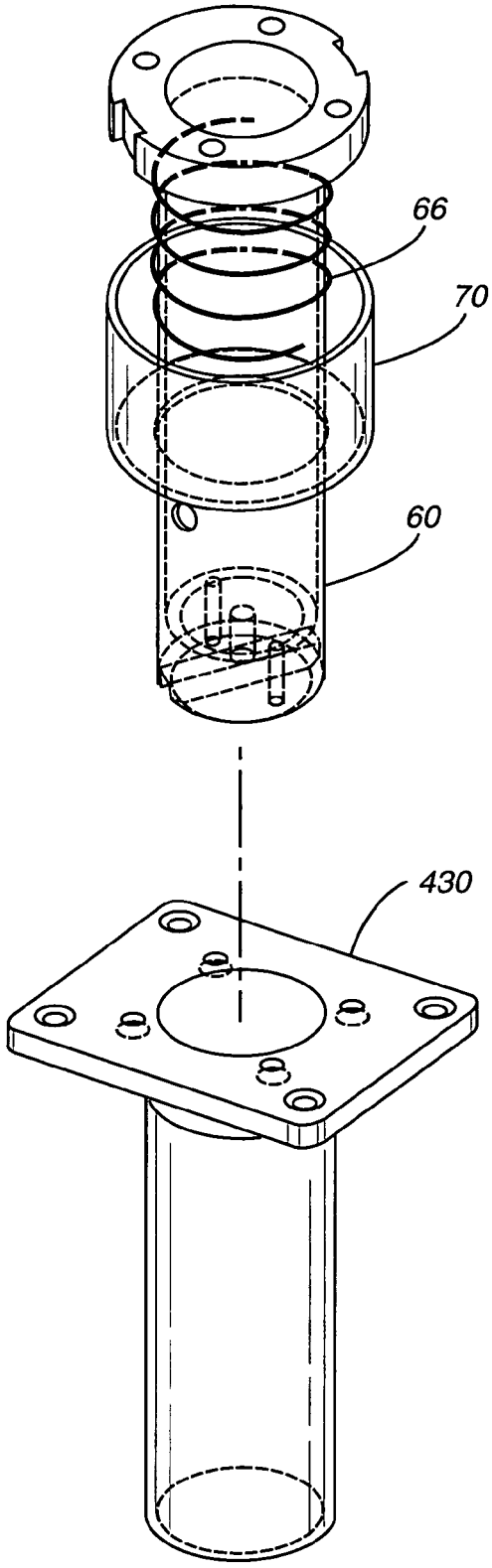
FIG. 18 is an exploded view partially in perspective of a portion of an apparatus previously described.
Figure 20:
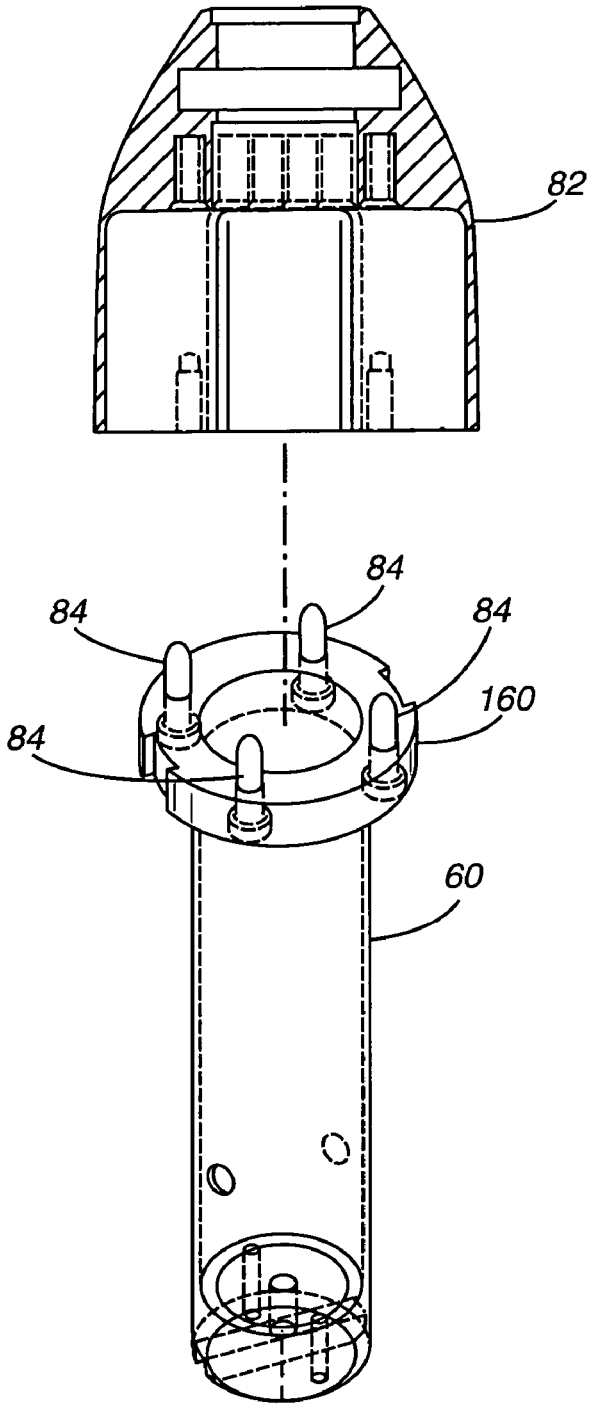
FIG. 20 is an exploded view, partially in elevation, and section and partially in perspective of the portions shown in FIGS. 9 and 19.

The mounting means for the holder is part number 82 FIG. 20 and its associated mounting plate 430 FIGS. 11 and 18 and screws 190.

The bearing means 120 is the bearings 124 FIGS. 28 and 24, the surface of the slot 128 in part 82 upon which the bearings ride, and the spring 122 that holds the bearings in the slot.

Figure 25:
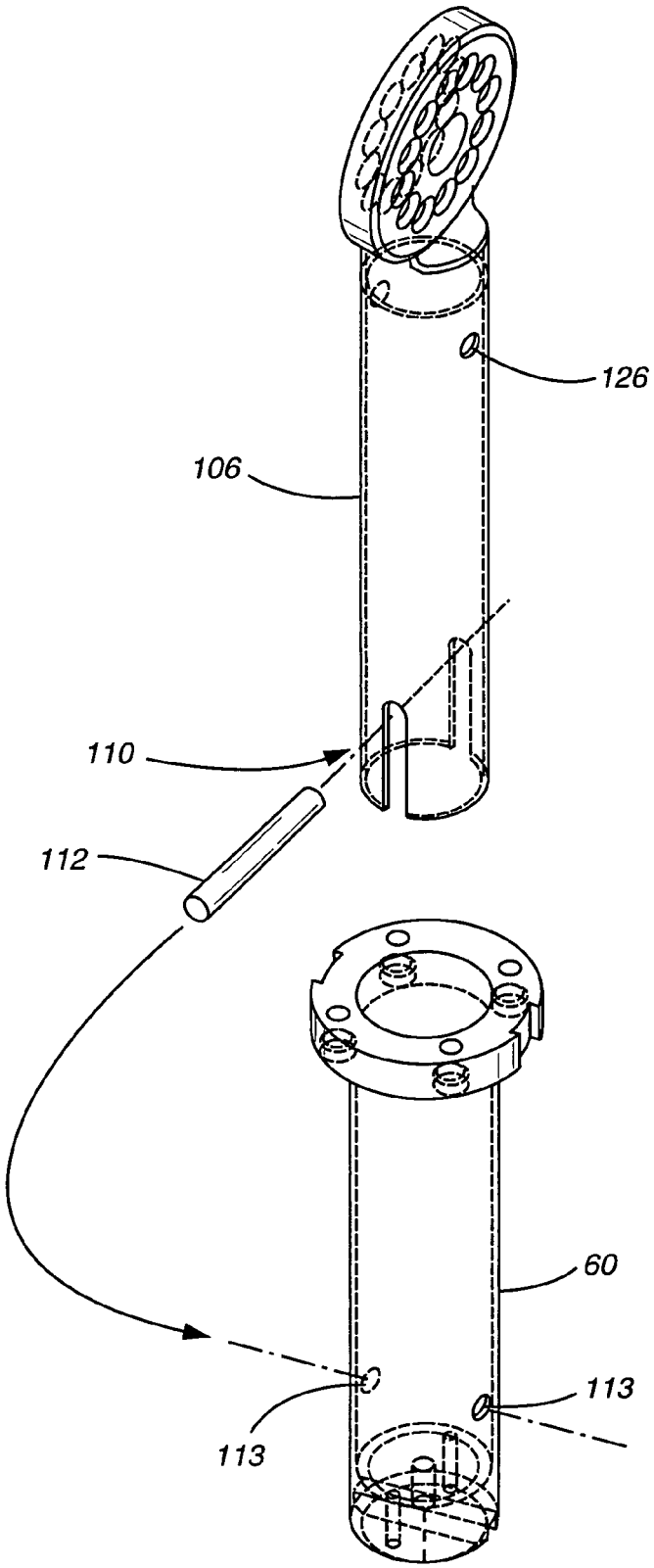
FIG. 25 is an exploded view in perspective of portions of an apparatus.
Figure 26:
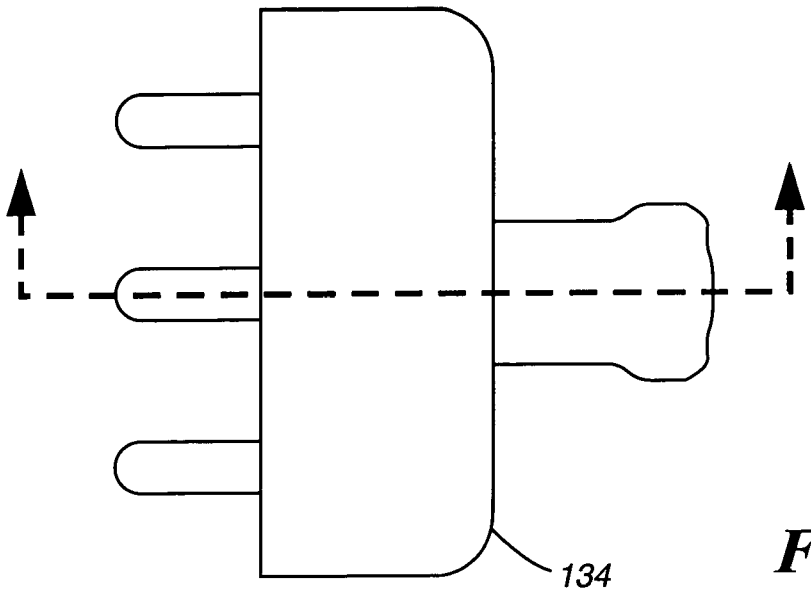
FIG. 26 is a side elevation of a portion of an apparatus.

To index the holder 106, a lock 60 is provided with a pin 112 FIG. 25 fixed therein. The pin is positioned to be engaged by the forked end 110 of the holder 106. The lock 60 has pins 84 FIG. 20 which mate with holes 86 FIG. 19 in the part 82 and retain the lock and the holder in a fixed position. A release and turning mechanism is provided for pulling the lock 60 downwardly to disengage the pins 84 from the holes 86 in part 82; thereby allowing the lock 60 to be rotated in a horizontal plane. Since the pin 112 is still embraced by the holder 106 (because it is in the slot in the forked end 110), the holder 106 turns with the lock 60. When the release and turning mechanism is released, the lock is returned upwardly and the pins on the lock 60 re-engage with the holes 86 and, thereby, hold the outrigger holder in a different fixed position. That process is what is called "indexing"; i.e. adjusting the outrigger holder to a plurality of fixed positions in a horizontal plane.

What is claimed is:

1. An outrigger holder apparatus of a boat comprising a mounting means for mounting an outrigger holder on a T-top of a boat; said mounting means further comprising a housing means for fixedly mounting the outrigger holder apparatus on said T-top;

an outrigger holder means mounted in said housing means for rotation therein;

a bearing means engaging said outrigger holder and said housing means for providing a bearing therebetween positioned above the T-top to bear the weight of the outrigger holder above the T-top upon rotation of the outrigger holder;

said mounting means for the outrigger holder further comprising an indexing means for adjusting the position of the outrigger holder means to a plurality of fixed positions in a horizontal plane from underneath the T-top upon which the outrigger holder means is mounted;

said indexing means having a first portion engaging said housing means for rotation therewith and a second portion for selectively engaging and disengaging with said first portion; said second portion when disengaged from said first portion being positioned to engage and rotate said outrigger holder means without bearing the weight of the outrigger holder means.

2. The outrigger holder apparatus of claim 1 further comprising a release and turning mechanism engaging said mounting means for the outrigger holder means for moving the outrigger holder to and holding the outrigger holder in, a plurality of fixed horizontal positions.

3. The outrigger holder apparatus of claim 2 wherein the release and turning mechanism further comprises a lock engaging said outrigger holder and said mounting means; said lock being movable to disengage said lock from said mounting means and thereby allow said lock to be rotated in a horizontal plane to rotate the outrigger holder to a different fixed position.

* * * * *